US009011074B2

(12) United States Patent
Diehr et al.

(10) Patent No.: US 9,011,074 B2
(45) Date of Patent: Apr. 21, 2015

(54) DEVICE AND METHOD FOR TURNING STACKS OF SHEET-SHAPED MATERIAL

(75) Inventors: Wolfgang Diehr, Grevenbroich (DE); Uwe Hartstock, Nettetal (DE); René Heider, Mönchengladbach (DE); Tomasz Ollek, Düsseldorf (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 378 days.

(21) Appl. No.: 13/281,633

(22) Filed: Oct. 26, 2011

(65) Prior Publication Data

US 2012/0099956 A1 Apr. 26, 2012

(30) Foreign Application Priority Data

Oct. 26, 2010 (DE) ..... 10 2010 049 376

(51) Int. Cl.

| | |
|---|---|
| ***B65G 7/08*** | (2006.01) |
| ***B65H 15/02*** | (2006.01) |
| ***B65H 1/30*** | (2006.01) |
| ***B65H 31/30*** | (2006.01) |
| ***B65H 5/00*** | (2006.01) |
| ***B65H 5/06*** | (2006.01) |

(52) U.S. Cl.

CPC ..... *B65H 15/02* (2013.01); *B65H 1/30* (2013.01); *B65H 31/3018* (2013.01); *B65H 2301/4222* (2013.01); *B65H 2301/42242* (2013.01); *B65H 2405/51* (2013.01); *B65H 2701/1764* (2013.01); *B65H 5/006* (2013.01); *B65H 5/066* (2013.01); *B65H 2404/1523* (2013.01); *B65H 2404/1544* (2013.01)

(58) Field of Classification Search

CPC ..... B65G 7/08

USPC ..... 414/758, 754, 759, 761–767, 771, 774, 414/783, 816, 790.2, 791.3, 791.6, 792; 53/587; 156/446

See application file for complete search history.

(56) References Cited

U.S. PATENT DOCUMENTS

| | | | | | |
|---|---|---|---|---|---|
| 1,799,938 | A | * | 4/1931 | Wadsworth | 414/758 |
| 3,063,575 | A | * | 11/1962 | Fontana | 414/776 |
| 3,770,141 | A | * | 11/1973 | Tolf et al. | 414/765 |
| 3,895,722 | A | * | 7/1975 | Pluntz | 414/766 |
| 3,948,385 | A | * | 4/1976 | Shinomiya | 198/403 |
| 3,994,118 | A | * | 11/1976 | Felix | 53/529 |

(Continued)

FOREIGN PATENT DOCUMENTS

| | | | |
|---|---|---|---|
| CA | 1338725 | C | 11/1996 |
| DE | 3735486 | A1 | 2/1989 |

(Continued)

*Primary Examiner* — Saul Rodriguez
*Assistant Examiner* — Lynn Schwenning
(74) *Attorney, Agent, or Firm* — Laurence A. Greenberg; Werner H. Stemer; Ralph E. Locher

(57) ABSTRACT

A device and a method for turning stacks of sheet-shaped material include a device for transporting the stacks into a pivot fork. The pivot fork is part of a turning unit and includes upper grippers, lower grippers and a stack stop. The pivot fork is open on one side to receive the stacks. The pivot fork is supported at its other end to pivot on a horizontal pivot shaft that extends in a direction transverse to a direction of introduction of the stacks and is disposed off-center relative to the pivot fork.

4 Claims, 10 Drawing Sheets

(56) References Cited

U.S. PATENT DOCUMENTS

| | | | | |
|---|---|---|---|---|
| 4,573,863 | A * | 3/1986 | Picotte | 414/763 |
| 4,700,941 | A | 10/1987 | Shill | |
| 4,735,539 | A * | 4/1988 | Hakkinen et al. | 414/281 |
| 4,784,558 | A | 11/1988 | Toriyama | |
| 4,911,608 | A * | 3/1990 | Krappitz et al. | 414/796 |
| 5,299,793 | A * | 4/1994 | Couturier | 270/39.06 |
| 5,743,374 | A | 4/1998 | Monsees | |
| 5,878,864 | A * | 3/1999 | Feldkamper | 198/409 |
| 5,996,314 | A * | 12/1999 | Pennini et al. | 53/399 |
| 6,322,316 | B1 * | 11/2001 | Hart et al. | 414/798.6 |
| 6,793,454 | B2 | 9/2004 | Brizzi | |
| 7,284,946 | B2 | 10/2007 | O'Neil | |
| 7,462,012 | B2 * | 12/2008 | Hart et al. | 414/790.9 |
| 2005/0002771 | A1 * | 1/2005 | Gelli et al. | 414/758 |

FOREIGN PATENT DOCUMENTS

| | | | |
|---|---|---|---|
| DE | 8901996 | U1 | 4/1989 |
| DE | 3805974 | A1 | 9/1989 |
| DE | 29801018 | U1 | 4/1998 |
| DE | 19730080 | A1 | 1/1999 |
| DE | 69322406 | T2 | 4/1999 |
| EP | 0329945 | A1 | 8/1989 |
| EP | 0802137 | A2 | 10/1997 |
| EP | 0931741 | A1 | 7/1999 |
| EP | 1350748 | A2 | 10/2003 |
| JP | 6183611 | A | 7/1994 |

* cited by examiner

DEVICE AND METHOD FOR TURNING STACKS OF SHEET-SHAPED MATERIAL

CROSS-REFERENCE TO RELATED APPLICATION

This application claims the priority, under 35 U.S.C. §119, of German Patent Application DE 10 2010 049 376.7, filed Oct. 26, 2010; the prior application is herewith incorporated by reference in its entirety.

BACKGROUND OF THE INVENTION

Field of the Invention

The present invention relates to a device and a method for turning stacks of sheet-shaped material, including a device for transporting the stacks into a pivot fork of a turning unit, the pivot fork including at least one upper gripper, at least one lower gripper and at least one stack stop and the pivot fork having an opening on one side for introducing stacks and being pivotable on its other end about a horizontal pivot shaft extending transverse to the direction of introduction of the stacks.

In the production of printed products, for instance folding boxes, for the packaging industry, sheets are printed across their width in a printing press. Each sheet includes a number of blanks of the folding box to be produced. After the printing process, the individual blanks are cut out in a flat-bed die cutting machine in which they are positioned with their printed side facing upward and are deposited in stacks. The cut and stacked folding box blanks are then fed to a folder-gluer with their printed sides facing downward. The blanks are then processed into folding boxes in the folder-gluer.

The stacked folding box blanks thus need to be turned over before being processed in the folder-gluer. That is a very troublesome process which sometimes requires a machine operator to turn over several tons of cardboard every day.

German Published, Prosecuted Patent Application DE-AS 1 065 075 discloses a turning table for a stacking device. The turning table includes a clamping plate and a clamping and conveying unit. An actuating drive is provided to drive a closing movement between the clamping plate and the conveying unit to clamp an object. A further actuating drive is used to turn the device in the direction of transport of the object through 180° about pivots disposed at the center of the turning table in order for the clamped stacked cardboard blanks to be turned. Having been turned, the blanks rest on the conveying unit which will then transport them out of the turning device.

A further turning device is known from European Published Patent Application EP 1 350 748 A2, corresponding to U.S. Pat. No. 6,793,454. The disclosed turning device includes a turning clamp that pivots about a horizontal axis disposed at the center. The turning clamp includes two transport elements. One of the transport elements is a series of rollers and is used to receive the stacks that enter the device. The other transport element is a conveying belt that is used to move the stacks out of the device with the aid of a pusher carriage after they have been turned over.

Another device for turning stacks is known from U.S. Pat. No. 5,743,374. The disclosed device includes a clamp for receiving the stacks and is moved laterally by a motor to receive and transport the stack. Another motor moves the clamp of the device along a U-shaped path in the device through rollers provided on an outer side of the clamp, thus turning the stack and depositing it on a hopper.

SUMMARY OF THE INVENTION

It is accordingly an object of the invention to provide an alternative device and method for turning stacks of sheet-shaped material, which overcome the hereinafore-mentioned disadvantages of the heretofore-known devices and methods of this general type and which operate in a simple, safe and reliable way.

With the foregoing and other objects in view there is provided, in accordance with the invention, a device for turning stacks of sheet-shaped material, comprising a device for transporting the stacks into a pivot fork of a turning unit. The pivot fork of the turning unit includes upper grippers, lower grippers, and a stack stop. At one end, the pivot fork has an opening for introducing stacks. At the other end, the pivot fork is supported to pivot about a horizontal pivot shaft that extends in a direction transverse to the direction of introduction of the stack. The pivot shaft is disposed off-center relative to the pivot fork. Adaptability to different formats is advantageously achieved by arranging the stack stop to be adjustable relative to the lower grippers. In accordance with a further advantageous embodiment, the stack stop is subdivided into two or more parts. Due to this feature, the device can be easily adapted to guiding asymmetrical blanks.

In accordance with another, particularly preferred, feature of the invention, the pivot shaft which is disposed off-center relative to the pivot fork, is in the upper region of the pivot fork. Due to this feature, pivot angles of the pivot fork of more than 180° can easily be achieved. Thus, it is possible to deposit the stack on an inclined plane. A horizontal change of path as well as a height change of the stack is attained by the pivoting movement, due to the placement of the pivot shaft off-center in the upper region.

In accordance with a further advantageous feature of the invention, the lower grippers are disposed in lateral parts of the device and are adjustable in terms of their height relative to the upper grippers. Height adjustment is advantageously achieved by servomotors or pneumatic or hydraulic cylinders. Thus, the stack can be clamped in a simple manner between the upper grippers and the lower grippers to ensure that the stack is securely held during the pivoting movement. Since the clamping may occur at any time during the pivoting movement, it is advantageously possible to pivot the stack without its being clamped at first up to a pivot angle of 70°. Consequently, the stack will automatically align against the stack stop and the lower grippers. If desired, the alignment of the stack may additionally be assisted by vibrating the pivot fork. After the alignment process, i.e. after the stack has been pivoted through an angle of approximately 70°, the stack may be clamped to ensure that it is safely held during the remaining pivoting process.

In accordance with an added particularly preferred, feature of the invention, the upper grippers are embodied as rolling tracks. This embodiment has a number of advantages: the rolling tracks can be moved out from below the stack after the turning process without causing the blanks to be marked as the belts roll off directly underneath the stack. At the same time, it is possible to provide maximum support even to stacks of asymmetrical blanks when a number of rolling tracks are used, since the rolling tracks may be inserted to different extents and may be moved individually when they are to be retracted.

In accordance with an additional feature of the invention, the lower grippers and/or upper grippers are disposed to be freely positionable in a direction transverse to the direction of introduction of the stacks. Thus, easy adaptability to different blank formats is achieved. In addition, when more than two lower grippers and/or upper grippers are being used, further adaptation to asymmetrical blanks is easily possible.

In accordance with yet another preferred feature of the invention, the pivot fork is adjustable through the use of a height adjustment device. The height adjustment device is disposed on the lateral parts of the device and the pivot shaft is supported in guides in the lateral parts of the device. Thus, the height of the turned stack relative to the residual stack in the feeder is easily adjustable. Likewise, while the rolling tracks are being pulled out, the pivot fork may be further adapted to the decreasing residual stack in the feeder. Thus, the spacing between the upper edge of the residual stack and the lower edge of the turned stack remains approximately constant. This fact has a positive effect on the falling behavior of the turned stack. Advantageously, the height adjustment device is disposed obliquely in the lateral parts of the device and the pivot shaft is supported in oblique guides in the lateral parts of the device. In accordance with a preferred embodiment, the height adjustment device may be formed of a rack and a driven pinion. However, any other height adjustment by motor, pneumatic cylinder, or hydraulic cylinder is likewise possible.

In accordance with yet a further, particularly preferred, feature of the invention, the transport device for transporting the stacks into the pivot fork has a bipartite construction. The first part of the transport device is located in the stack feeding device and extends almost as far as the start of the pivot fork. The second part of the transport device extends across the depth of the pivot fork. The two transport devices advantageously have independent individual drives. Thus, they can be separately operated using sensors and controls. Even different speeds are possible. Thus, gaps of varying sizes between the individual stacks can be compensated for and a new stack will always be available in a stand-by position while a stack is being turned in the pivot fork.

With the objects of the invention in view, there is concomitantly provided a method of turning stacks, which comprises the following steps:

a) feeding a stack into the pivot fork against a stack stop;
b) lifting the stack through the use of height-adjustable lower grippers or by rotating the pivot fork;
c) pivoting the pivot fork through an angle of approximately 70°;
d) aligning the stack against the stack stop and the lower grippers;
e) clamping the stack between lower grippers and upper grippers by further height-adjustment of the lower grippers;
f) continuing the pivoting operation until a final position is reached;
g) retracting the upper grippers;
h) depositing the turned stack;
i) rotating the pivot fork back and extending the upper grippers into the starting position; and
j) repeating steps a) to i) until all stacks are turned.

Advantageously, the stacks are aligned up to a pivoting angle of approximately 70°. Since the pivoting angle may be more than 180°, it is possible to deposit the stacks on an inclined plane.

Other features which are considered as characteristic for the invention are set forth in the appended claims.

Although the invention is illustrated and described herein as embodied in a device and a method for turning stacks of sheet-shaped material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
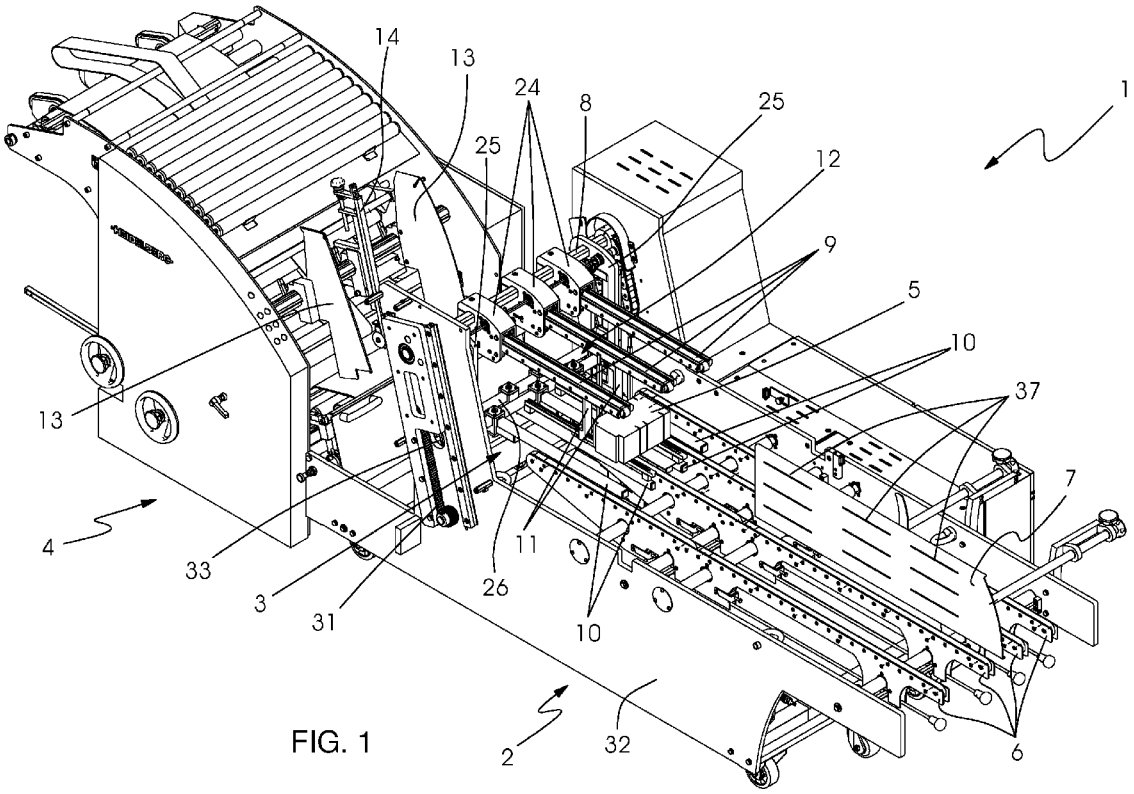
FIG. 1 is a diagrammatic, perspective view of a device according to the invention including a stack feeding device, a turning unit, and a feeder.

Referring now to the figures of the drawings in detail and first, particularly, to FIG. 1 thereof, there is seen a device 1 according to the invention for turning stacks 5. The stacks 5 are fed to a pivot fork 12 of a turning unit 3 through the use of a stack feeding device 2. Roller cheeks 6 are provided to feed the stacks 5, which are aligned in the lateral direction, against a stack alignment plate 7. The stack alignment plate 7 may advantageously include height marks 37 to aid the operator in providing stacks of acceptable weight with respect to given tolerances. The roller cheeks 6 transport the stacks 5 as far as a stack stop 11 formed on the pivot fork 12. Alternatively, this transport can be carried out by a subdivided roller cheek system 6, 6', which will be explained in more detail with reference to FIG. 7A. Lower grippers 10 of the pivot fork 12 are provided underneath and between the roller cheeks 6. The lower grippers 10 are adjustable in terms of their height and lift the stack 5 that has been introduced into the pivot fork 12. Alternatively, the stack may be lifted by pivoting the pivot fork. The pivot fork 12 additionally includes upper grippers 9, which are disposed on a pivot shaft 8 through drive heads 24 so as to pivot about the pivot shaft 8. The lower grippers 10 are disposed on the pivot shaft 8 through a crossbar 26 and lateral parts 25 and likewise pivot about the pivot shaft 8. During a pivoting process, the stack 5 will align against the lower grippers 10 and the stack stop 11 and will then be clamped between the upper and lower grippers 9, 10 by a further height adjustment of the lower grippers 10 relative to the upper grippers 9. During a further pivoting movement, the stack 5 rests on the upper grippers 9. When the pivoting movement is completed, the upper grippers 9 will be retracted and the stack 5 will fall down a chute closed on four sides and formed by adjustment tongues 14, lateral stack guides 13 and the stack stop 11, to be deposited in a feeder 4. The device 1 has lateral parts 32 with guides 33 extending obliquely therein. A height adjustment device 31 is disposed on the lateral parts 32 for adjusting a height of the pivot fork 12. The pivot shaft 8 is supported in the guides 33.

Figure 2:
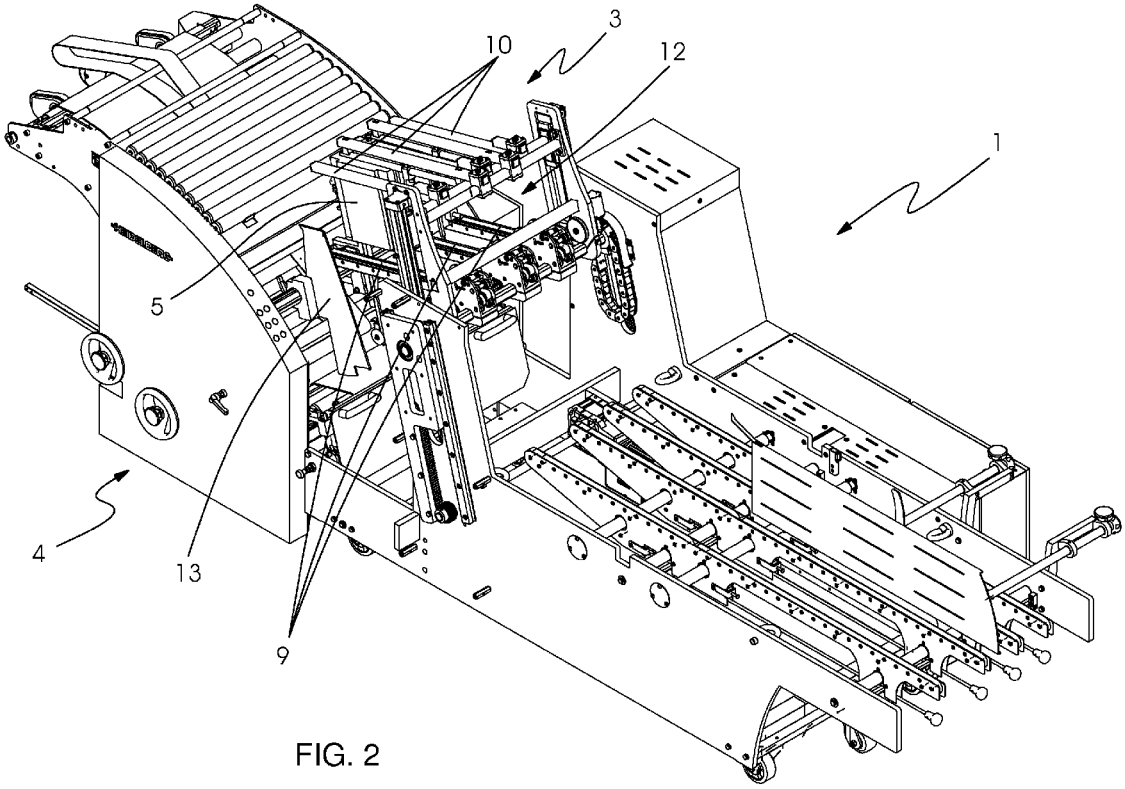
FIG. 2 is a perspective view of the device shown in FIG. 1 after completion of a turning process.

FIG. 2 illustrates a condition at an end of the pivoting movement. The stack 5 has been turned and is clamped between the upper and lower grippers 9, 10.

Figure 3:
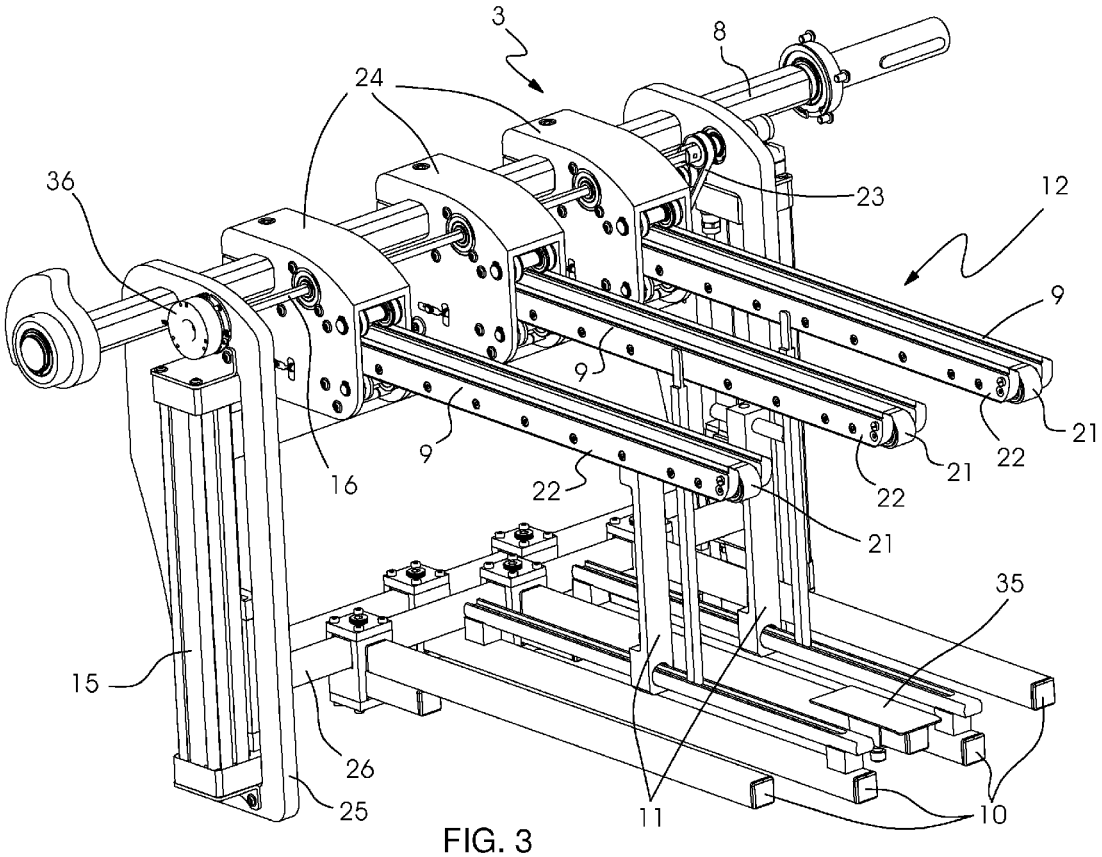
FIG. 3 is a side-perspective view of important parts of the turning unit of the invention.
Figure 4:
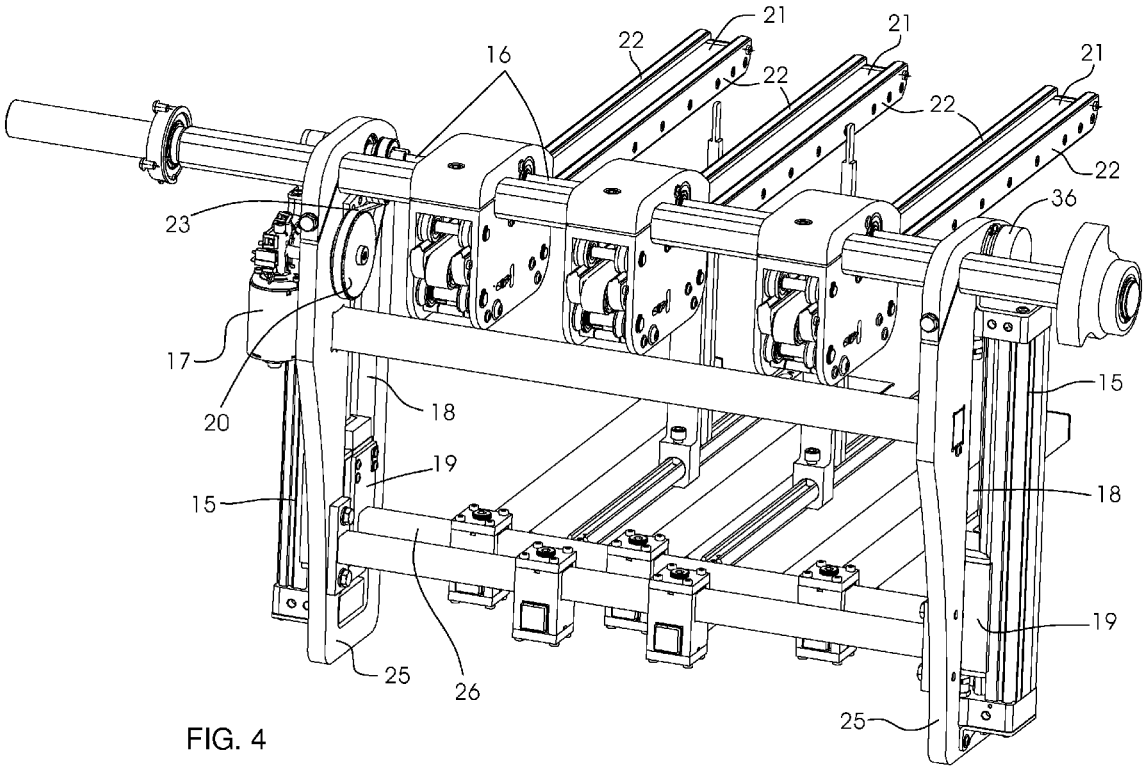
FIG. 4 is a further side-perspective view of the important parts of the turning device of the invention.

FIGS. 3 and 4 illustrate important parts of the turning unit 3 of the invention within the device 1. The turning device 3 includes the pivot fork 12 including the upper grippers 9 and lower grippers 10 as well as the stack stop 11. The stack stop 11 is adjustably disposed on the lower grippers 10. Thus, the pivot fork 12 is easy to adjust to accommodate stacks of different, even asymmetrical formats. The stack may be turned using only one lower gripper 10 for blanks of small width. In order to prevent the stack from tilting, a clip-on element 35 may advantageously be mounted to the lower gripper 10 to increase the support surface for the stack, thus contributing to an easier alignment of the lower gripper relative to the center of gravity of the stack. The clip-on element is advantageously of smaller width than two lower grippers next to each other. The upper grippers 9 are embodied as rolling tracks 22 that are driven by belts 21 which are in turn driven by a motor 17, a sprocket 20, a timing or sprocket belt 23, and a square shaft 16 (as will be explained in more detail below with reference to FIG. 5). When the stack is turned or an emergency stop occurs, the rolling tracks 22 may slowly slide downward, depending on the position of the pivot fork 22 (for instance in the vertical position). This is advantageously prevented by the torque of the short-circuited motor 17 as well as by a spring force brake 36.

The upper grippers 9 are mounted in the so-called drive heads 24. The drive heads 24 are supported on the pivot shaft 8 about which the entire pivot fork 12 may be pivoted. The lower grippers 10 are mounted to the crossbar 26, which is supported in guides 18 in the lateral parts 25 of the pivot fork 12 and can be adjusted in terms of their height relative to the upper grippers 9 by a linear drive 15. The linear drive may be a servomotor, a pneumatic cylinder, or a hydraulic cylinder.

Figure 5:
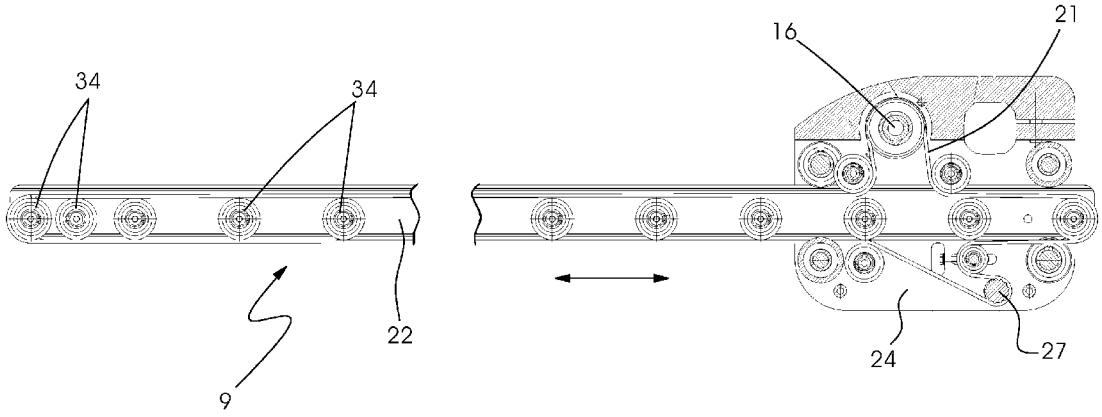
FIG. 5 is an enlarged, fragmentary, sectional view of an upper gripper.

The functioning of the upper grippers 9 becomes apparent from FIG. 5. A belt 21, guided by various rollers 34 and a drive shaft 16, extends within the rolling track 22. A tensioning element 27 is provided for adjusting the tension of the belt. When the belt 21 is driven by the drive shaft 16, the rolling track is displaced relative to the drive head 24 in the direction of the arrow.

FIGS. 6A-6H are diagrammatic representations of the sequence of movements of the turning device of the invention.

Figure 6A:
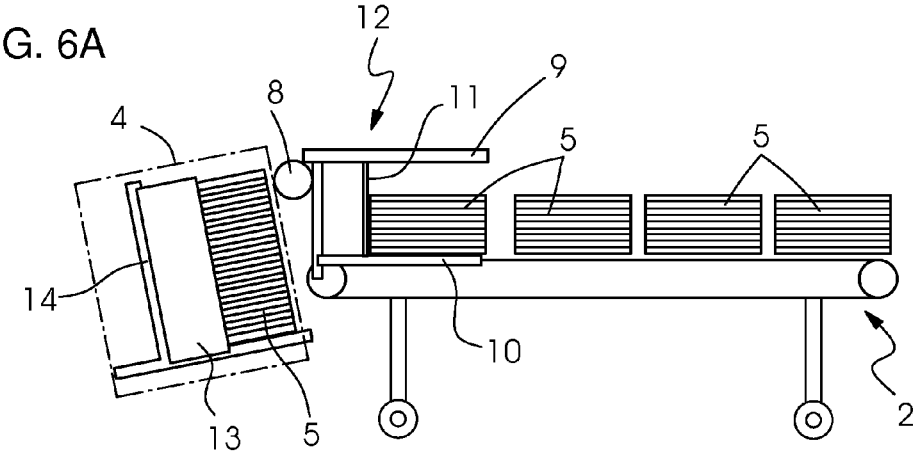
FIGS. 6A-6H are side-elevational views representing movement of a pivoting process.
Figure 6B:
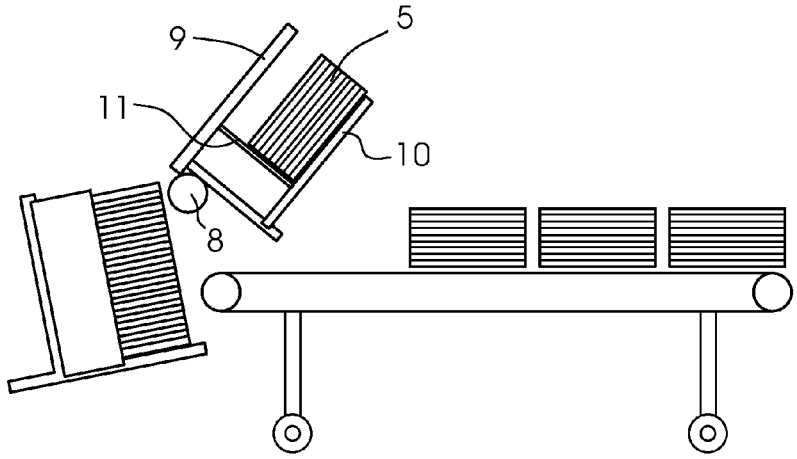
Figure 6C:
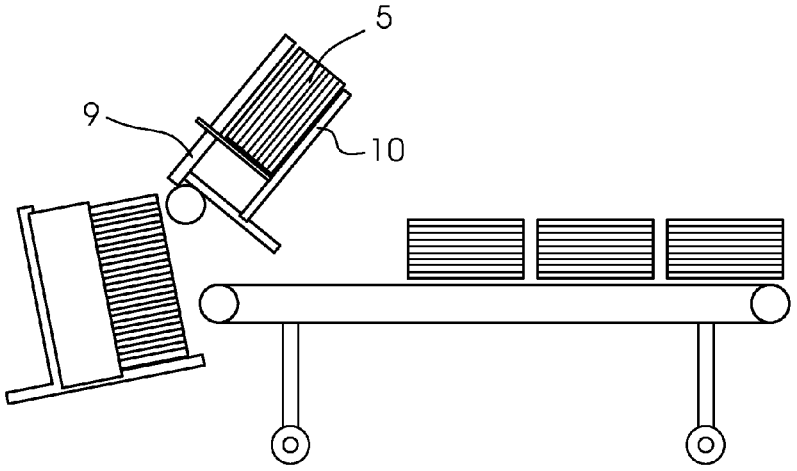

In FIG. 6A, the stack feeding device 2 introduces the stack 5 into the pivot fork 12 as far as the stack stop 11. Subsequently, (FIG. 6B) the pivot fork 12 starts its pivoting movement about the pivot shaft 8 and lifts the stack 5. During this movement, the stack 5 aligns against the lower grippers 10 and the stack stop 11. This alignment process is completed after a pivoting movement through approximately 70°. Then the lower grippers 10 move in the direction of the upper grippers 9 (FIG. 6C) to clamp the stack 5 between the upper grippers 9 and the lower grippers 10. The stack 5 is pivoted further until it reaches its final position which is at a pivot angle of approximately 195° in the illustrated example (FIG. 6D).

Figure 6D:
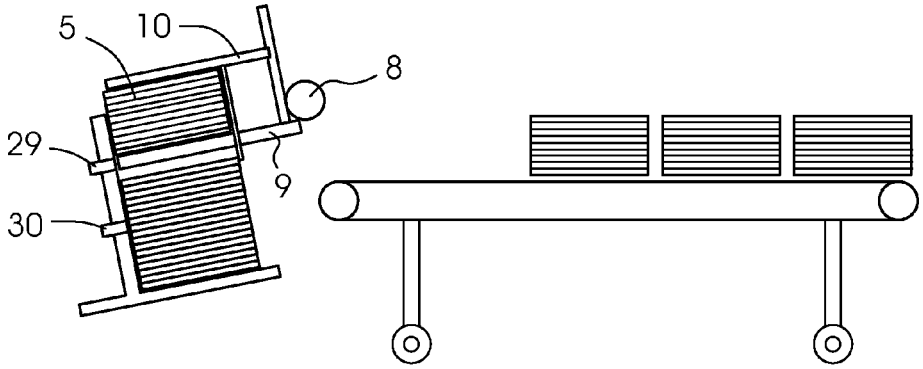
Figure 6E:
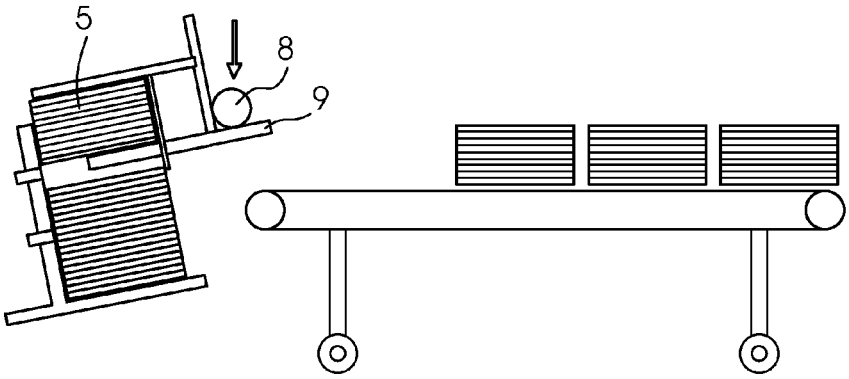
Figure 6F:
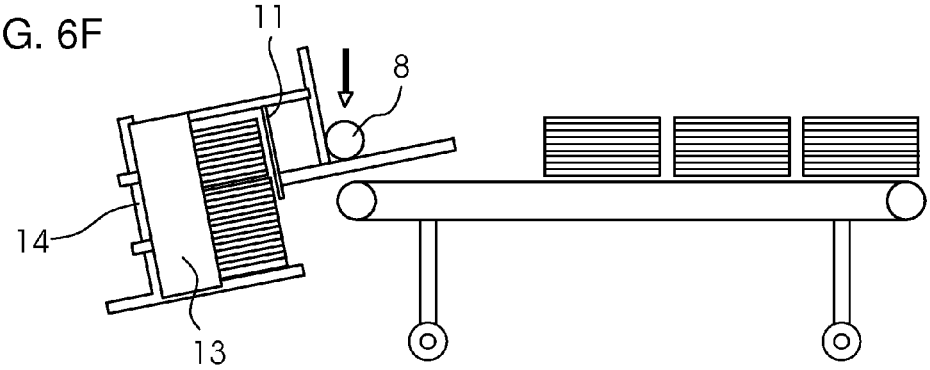
Figure 6G:
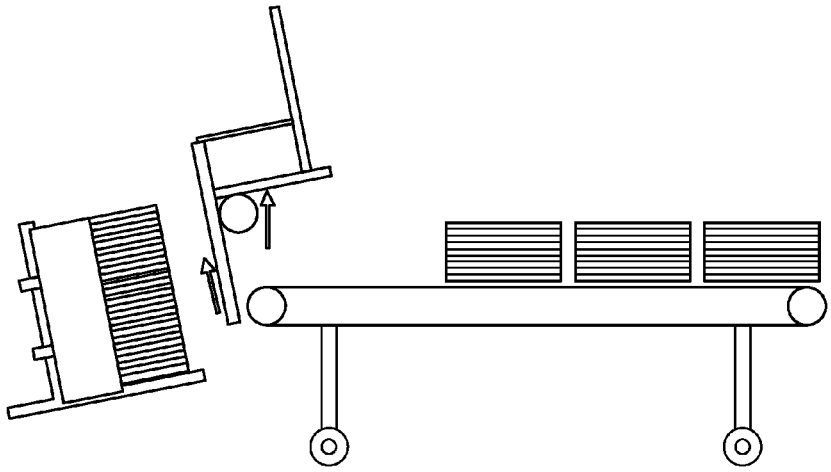
Figure 6H:
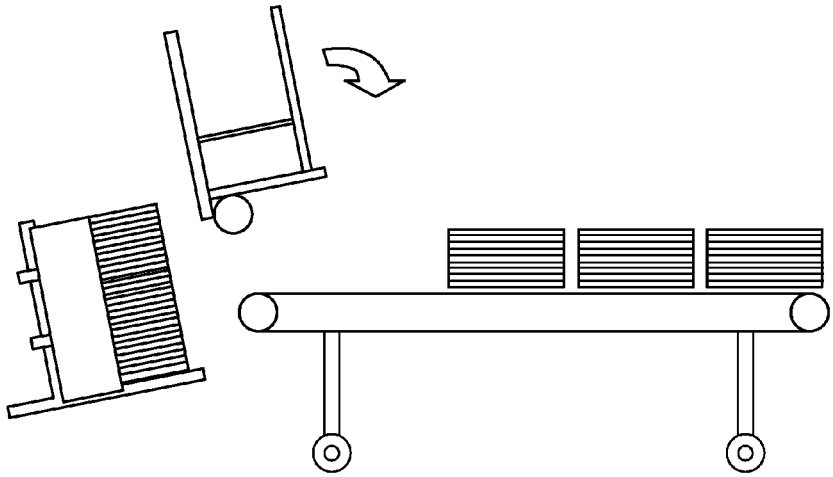

FIG. 6D further illustrates two sensors 29, 30. The height of the sensor 29 is manually adjustable by an operator. The sensor 29 provides signals to the pivot fork 12 when the stack provided in the feeder 4 has been processed down to a target height to indicate that a new stack 5 to be turned needs to be provided. The height of the lower sensor 30 is likewise adjustable. The sensor 30 provides a signal when the stack provided in the feeder 4 has reached a critical minimum height without a new turned stack having been introduced. The result of this signal may be that a downstream machine may be switched off. Once the turning process has been completed, the pivot fork 12, as shown in FIG. 6E, will be lowered almost down to the upper edge of the residual stack through the use of the height adjustment device 31 (seen in FIG. 1). Then the upper grippers 9, which are embodied as rolling tracks 22 as described above, are pulled out. While the movable rolling tracks 22 are being pulled out, the stack 5 continues to be clamped between the upper gripper 9 and the lower gripper 10 to prevent the stack 5 from prematurely sliding out of the pivot fork 12. As soon as the rolling tracks 22 have been completely pulled out from under the stack 5, the turned stack (FIG. 6F) as a whole will fall down the chute which is closed on four sides and formed by the adjustment tongues 14, the lateral stack guides 13 and the stack stop 11 into the feeder. In order to provide further assistance, the pivot fork 12 may additionally be lowered in the direction of the arrow by the height adjustment device 31. The height adjustment device 31 is controlled by the sensors 29 and a non-illustrated control unit. Subsequently, the pivot fork 12 rotates back into a position approximately 15° before the vertical position. At the same time, the pivot fork 12 is moved back into its uppermost position in the direction of the arrow through the use of the height adjustment device 31. Then the extendable rolling tracks 22 move into their initial position and the pivot fork finishes its rotation back into the initial position (FIG. 6H).

Figure 7A:
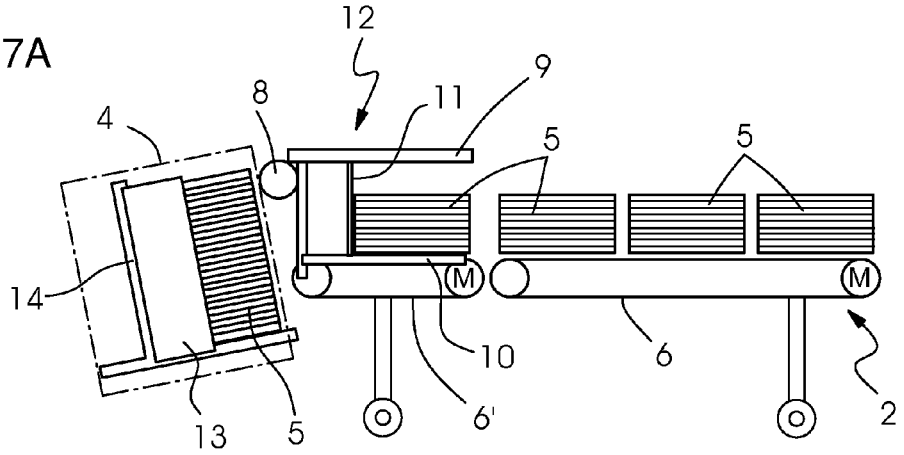
FIGS. 7A-7D are side-elevational views representing partial movements of the pivoting movement.

FIG. 7A illustrates an alternative sequence of movements during the feeding of the stack 5 into the pivot fork 12. In contrast to the stack feeding process illustrated in FIG. 6A, the roller cheeks 6 and 6' in FIG. 7A have a bipartite construction. The roller cheeks 6 have their own drive M. They transport the stack into the stack feeding device 2. The roller cheeks 6', which are likewise driven by their own drive M, transport the stack 5 into the pivot fork 12. The roller cheeks 6, 6' are controlled by non-illustrated sensors and a control unit. In the stack feeding device, the stacks 5 are transported to a park position at the end of the roller cheeks 6. When the pivot fork 12 is in a receiving position, the roller cheeks 6, 6' receive a signal causing them to transport the next stack 5 into the pivot fork 12. Different gaps in the stack feeding device 2 are compensated for due to the independent drives.

Figure 7B:
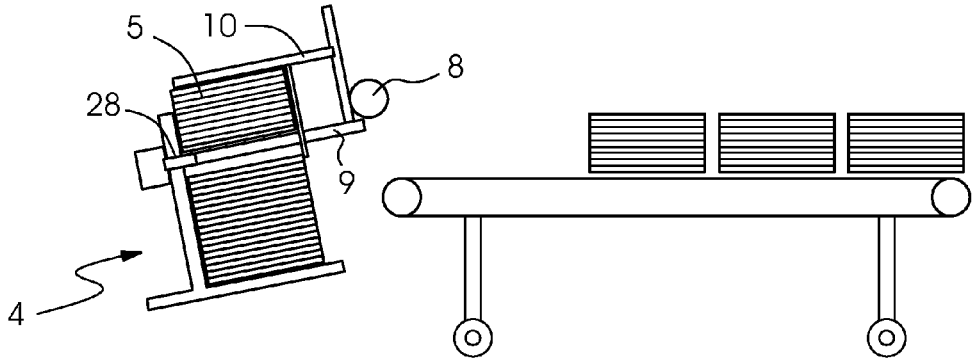
Figure 7C:
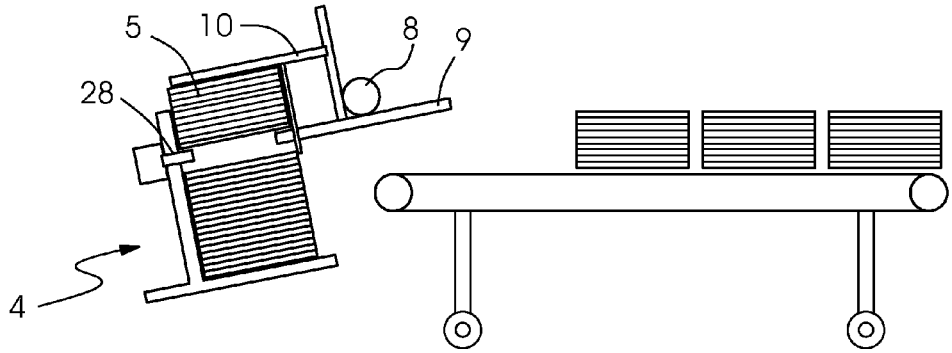
Figure 7D:
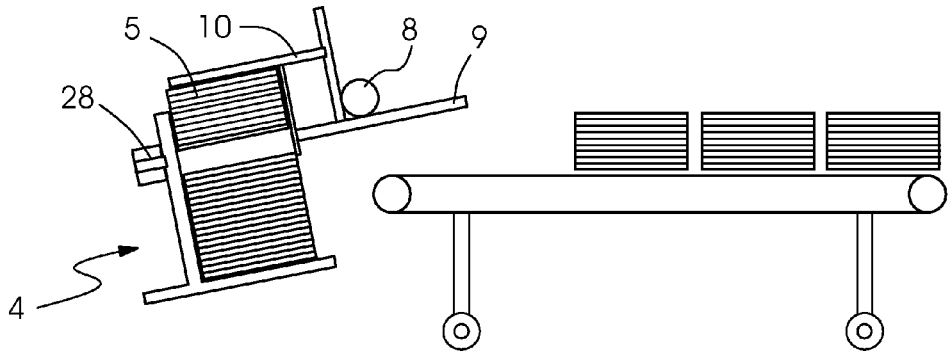

FIGS. 7B-7D illustrate an alternative further sequence of movements when the turned stack 5 is deposited in the feeder 4. The feeder may optionally include a front edge support 28 for supporting a front edge of the stack. The front edge support 28 may be adjustable in terms of its height and may be extended and retracted. It is extended to receive the front edge of the pivoted stack 5. The pivoted stack rests on the upper grippers 9 and on the front edge support 28. As shown in FIGS. 7C and 7D, the upper grippers 9, which are embodied as rolling tracks as described above, are pulled out. At the same time, the front edge support 28 is pulled out. Thus, the turned stack (FIG. 7D) will fall down the chute which is closed on four sides and formed by the adjustment tongues 14, the lateral stack guides 13 and the stack stop 11, to be deposited in the feeder 4 as described above.

The invention claimed is:

1. A method for turning stacks of sheet-shaped material, the method comprising the following steps:

a) feeding a stack to a stack stop in a pivot fork;

b) lifting the stack with height-adjustable lower grippers or by rotating the pivot fork;

c) pivoting the pivot fork through a pivot angle of approximately 70°;

d) aligning the stack against the stack stop and the lower grippers;

e) clamping the stack between the lower grippers and upper grippers by adjusting a height of the lower grippers;

f) continuing pivoting of the pivot fork until reaching a final position;

g) withdrawing the upper grippers;

h) depositing the turned stack;

i) rotating the pivot fork back and extending the upper grippers into an initial position; and j) repeating steps a) to i) until all stacks have been processed;

carrying out the steps b) through e) in sequential order from b) to e).

2. The method according to claim 1, which further comprises additionally adjusting a height of the pivot fork to adapt to a position of a residual stack.

3. A method for turning stacks of sheet-shaped material, the method comprising the following steps:

a) feeding a stack to a stack stop in a pivot fork;

b) lifting the stack with height-adjustable lower grippers or by rotating the pivot fork;

c) pivoting the pivot fork through a pivot angle of approximately 70°;

d) aligning the stack against the stack stop and the lower grippers;

e) clamping the stack between the lower grippers and upper grippers by adjusting a height of the lower grippers;

f) continuing pivoting of the pivot fork until reaching a final position;

g) withdrawing the upper grippers;

h) depositing the turned stack;

i) rotating the pivot fork back and extending the upper grippers into an initial position; and j) repeating steps a) to i) until all stacks have been processed;

carrying out the steps a) through i) in sequential order from a) to i).

4. The method according to claim 3, wherein clamping is avoided before step e) in order to allow for a proper alignment of the stack.

* * * * *